US006231680B1

(12) United States Patent
Gerlach et al.

(10) Patent No.: US 6,231,680 B1
(45) Date of Patent: May 15, 2001

(54) CLEANING METHOD USING A MIXTURE CONTAINING WOOD CHIPPINGS AND, OPTIONALLY, POLYASPARTIC ACID AND/OR A DERIVATIVE OF A POLYASPARTIC ACID

(75) Inventors: Manfred Gerlach, Leverkusen; Bernhard Lehmann, Aachen, both of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/463,093

(22) PCT Filed: Jul. 10, 1998

(86) PCT No.: PCT/EP98/04300

§ 371 Date: Feb. 16, 2000

§ 102(e) Date: Feb. 16, 2000

(87) PCT Pub. No.: WO99/05251

PCT Pub. Date: Feb. 4, 1999

(30) Foreign Application Priority Data

Jul. 23, 1997 (DE) ..... 197 31 573
Feb. 12, 1998 (DE) ..... 198 05 607

(51) Int. Cl.[7] ..... B08B 7/00

(52) U.S. Cl. ..... 134/7; 134/2; 134/3; 134/6; 134/8; 134/22.1; 134/22.11; 134/22.14; 134/22.19; 134/40; 134/41; 134/42; 510/108; 510/462; 510/477; 451/39

(58) Field of Search ..... 134/2, 3, 6, 7, 134/8, 22.1, 22.11, 22.14, 22.19, 40, 41, 42; 510/108, 477, 462; 451/39

(56) References Cited

U.S. PATENT DOCUMENTS

| | | | | |
|---|---|---|---|---|
| 4,839,461 | | 6/1989 | Boehmke | 528/363 |
| 4,959,154 | * | 9/1990 | Simmons | 210/680 |
| 5,443,651 | * | 8/1995 | Kalota et al. | 134/2 |
| 5,874,025 | * | 2/1999 | Hever et al. | 252/383 |
| 5,980,644 | * | 11/1999 | Ivanov | 134/6 |

FOREIGN PATENT DOCUMENTS

| | | | |
|---|---|---|---|
| 244061 | * | 5/1980 | (FR) . |
| 06093298 | * | 4/1994 | (JP) . |
| 08322916 | * | 12/1996 | (JP) . |
| WO 96/32235 | * | 10/1996 | (WO) . |

* cited by examiner

*Primary Examiner*—Sharidan Carrillo
(74) *Attorney, Agent, or Firm*—Joseph C. Gil; Diderico van Eyl

(57) ABSTRACT

A method for cleaning a surface by flooding and thereby cleaning a surface contaminated with deposits with a mixture containing water, wood chippings, and optionally, polyaspartic acid or a derivative of a polyaspartic acid.

3 Claims, No Drawings

CLEANING METHOD USING A MIXTURE CONTAINING WOOD CHIPPINGS AND, OPTIONALLY, POLYASPARTIC ACID AND/OR A DERIVATIVE OF A POLYASPARTIC ACID

FIELD OF THE INVENTION

The invention relates to a method of cleaning surfaces with a mixture containing water and wood chippings, to a specific mixture, and to its use as a cleaner.

BACKGROUND OF THE INVENTION

In the cleaning of equipment, in particular chemical reactors, pipes, dryers, storage containers and packaging plants, where deposits have formed during use, attempts are generally made to remove these deposits using solvents. However, the consumption of solvents is often very high and does not lead to the desired result. As a result, other cleaning methods, in particular those carried out manually, such as, for example, using high-pressure cleaners, are required in order to clean the equipment thoroughly. As well as being very labor-intensive, the results are often also unsatisfactory. This is the case particularly for equipment which [lacuna] in connection with the production, storage, conveyance and packaging of chemical products which have high purity requirements (GMP) such as, for example, photochemicals, pharmaceutical products or intermediates thereof.

DESCRIPTION OF THE INVENTION

We have now found a method of cleaning equipment, in which the soiled surfaces, in particular surfaces contaminated with deposits, are flooded with a mixture containing water and wood chippings.

Preferred wood chippings are rosin-free. Particular preference is given to wood chippings of meranti wood, and to the wood types bongossi, mahogany, sipo, khaya, lauan and sapelli and also subspecies of their families. The particle size of the wood chippings is preferably from 0.1 to 20 mm, in particular from 0.1 to 7 mm.

The ratio of water and wood chippings is in principle unimportant, provided that the mixture is flowable. Water is generally used in a considerable excess. The mixture preferably comprises from 70 to 99.9%. by weight of water and from 30 to 0.1% by weight of chippings, the sum of these two components preferably being >90, in particular >95% by weight, based on the total mixture. The wood chippings mixture used for cleaning can optionally comprise other additives such as, for example, organic solvents, salts, surfactants, surface-active substances, additives customary for cleaners, such as, for example, polyaspartic acid. Suitable surfactants are, for example, nonionogenic, surface-active substances such as polyglycol ethers, which are obtained by adding ethylene oxide to alcohols, alkyl phenols, fatty amines or carboxamides. It is also possible to use anionic surfactants, such as alkali metal salts or amine salts of fatty acids, alkylsulfonic acid or alkylbenzenesulfonic acids.

Dispersants which may further be added are, for example, phosphonates, polymer phosphates, polycarboxylic acids, citric acid, nitriloacetic acid, iminodisuccinic acid, polyacrylates and glyconates.

In particular, but not exclusively, the addition of polyaspartic acid known from EP-B 256 366 has proven successful.

The cleaning is preferably carried out in a neutral to slightly acidic medium. The wood chippings mixture preferably has a pH of from 3 to 7.

The cleaning method according to the invention is preferably carried out at a temperature from 0° C. to 120° C., in particular from 20 to 60° C., optionally under pressure.

Examples of equipment to be cleaned are chemical reactors, in particular stirred vessels, their inlet and outlet pipes, storage containers, dryers and packaging plants.

The equipment surfaces to be cleaned can, for example, be metallic or enameled. Preferred surface materials are metallic surfaces made from V2A or V4A steel, hastelloy, nickel or copper or enamels, and plastic surfaces such as, for example, rubberized surfaces.

The nature of the deposits is not subject to any limitation. They are preferably deposits which, when a product in the reactor, in the storage container, in the dryer or, for example, in the inlet and outlet pipes is changed, for example, from an intensely colored compound with high purity requirements such as photochemicals or else also pharmaceutical products or their precursors, contaminate the next product. The process according to the invention is preferably used to effectively remove activated carbon deposits, which have been obtained, for example, as a result of clarification stages of liquid products, and also oil- or fat-containing deposits.

Where the deposits are strongly adherent, it is possible to carry out high-pressure cleaning prior to treatment with wood chippings. Flooding of the equipment surfaces to be cleaned is, for example, carried out by stirring a mixture of water and wood chippings and optionally other additives, for example in a stirred vessel, or by passing over or passing through a suitable mixture through pipes which are provided with suitable deposits.

To clean a stirred vessel (SV), the latter is, for example, half-filled with water and, depending on the size, wood chippings (meranti) [lacuna] added. For a 6 $m^3$ SV, from 5 to 20 kg (corresponds to about 50 to 200 l) of wood chippings, preferably of meranti wood, are, for example, used. The SV is then filled with water and the contents are heated to a temperature of about 60° C. The wood chippings mixture is stirred for several hours depending on the degree of soiling. The contents of the SV are then cooled to about 40° C. and emptied via a filtration apparatus.

Pipes which are covered, for example with activated carbon can, for example, be flushed through with an aqueous wood chippings mixture.

It is particularly advantageous to use a mixture of wood chippings, water and polyaspartic acid.

The invention thus further relates to a mixture comprising water, wood chippings and polyaspartic acid and/or derivatives thereof.

Suitable wood chippings are therefore preferably those given above.

The polyaspartic acid is preferably used as a salt, in particular as the sodium or potassium salt. It is, however, also possible to use a derivative of polyaspartic acid, for example the anhydride of polyaspartic acid, namely polysuccinimide. For the purposes of the present invention, polyaspartic acid is also taken to mean salts of these acids. Preferred polyaspartic acids are, for example, known from EP-A 672 625.

In a preferred embodiment, the polyaspartic acid is prepared by subjecting maleic acid monoammonium salts to thermal, optionally continuous, polymerization preferably at from 150 to 180° C. in a reactor for a residence time of from 5 to 300 minutes, and converting the polysuccinimide obtained to polyaspartic acid or a salt thereof by hydrolysis.

In a preferred embodiment, the polyaspartic acid contains essentially repeating units of the following structure:

a)

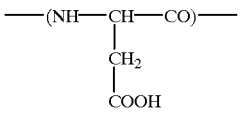

(α-form) and b)

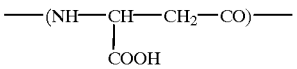

(β-form).

The proportion of the β-form is generally more than 50%, in particular more than 70%.

In addition to the repeating polyaspartic acid units a) and b), it is also possible for other repeating units to be present, e.g.:

c) malic acid units of the formula

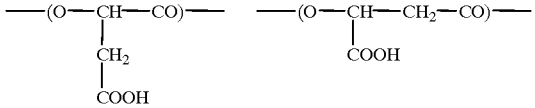

d) maleic acid units of the formula

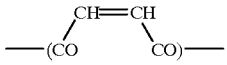

e) fumaric acid units of the formula

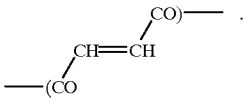

Preference is given to polymers with a molecular weight, according to gel permeation chromatographic analysis, of from 500 to 10,000, preferably from 1000 to 5000, particularly preferably from 2000 to 4000 g/mol.

The invention also relates to the use of the mixture according to the invention as a cleaner.

The equipment surfaces cleaned by the process according to the invention have excellent cleanliness, with which subsequent rearrangement i.e. change of the product is very readily possible, without impurities of the preceding product being detectable.

Although the present invention has been described in detail with reference to certain preferred versions thereof, other variations are possible. Therefore, the spirit and scope of the appended claims should not be limited to the description of the versions contained therein.

EXAMPLE 1

A 5 l enamel pot was contaminated with a "standard soiling", consisting of 90% by volume of castor oil and 10% by volume of activated carbon. A mixture of 2000 ml of water, 50 ml of wood chippings of meranti wood (particle size ca. 10 $mm^2$) and 10 ml of polyaspartic acid (as a 42% strength Na salt solution; viscosity from 30 to 60 mPas; pH 9.5 to 10.5; density 1.2 $g/cm^3$; molecular weight from 2000 to 3000 g/mol)

was used for the cleaning. For this, the mixture was used in the contaminated enamel tank for 20 min at 65° C. with stirring. The contaminated surface was completely cleaned. The same result was achieved when the mixture was stirred for 20 minutes in the tank at room temperature.

What is claimed is:

1. A method for cleaning a plastic surface comprising the step of flooding a plastic surface contaminated with deposits with a mixture comprising (i) water, (ii) chippings of woods selected from the group consisting of merantis, bongossis, mahoganies, sipos, khayas, lauans, and sapellis, and (iii) a member selected from the group consisting of polyaspartic acid, salts of polyaspartic acid, and polysuccinimide, and thereby cleaning the plastic surface.

2. The method of claim 1, wherein the wood chippings consist essentially of meranti wood.

3. A cleaning mixture consisting of water, chippings of woods selected from the group consisting of merantis, bongossis, mahoganies, khayas, lauans, and sapellis, and a member selected from the group consisting of polyaspartic acid and derivatives of polyaspartic acid.

* * * * *